US005078332A

United States Patent [19]

Carter

[11] Patent Number: 5,078,332

[45] Date of Patent: Jan. 7, 1992

[54] DISPENSER FOR PLASTIC FLEX CONDUIT

[76] Inventor: E. Ray Carter, 2515 N. 7th St., Phoenix, Ariz. 85006

[21] Appl. No.: 608,355

[22] Filed: Nov. 2, 1990

[51] Int. Cl.[5] ..... B65H 49/28

[52] U.S. Cl. ..... 242/129

[58] Field of Search ..... 242/129, 128, 54 R, 242/105

[56] References Cited

U.S. PATENT DOCUMENTS

| | | | |
|---|---|---|---|
| 2,990,135 | 6/1961 | Croteau et al. | 242/129 |
| 3,127,127 | 3/1964 | Kohn et al. | 242/129 |
| 3,371,885 | 3/1968 | Douglas | 242/129 |
| 3,464,647 | 9/1969 | Jacobi | 242/129 |
| 3,593,943 | 7/1971 | Collmann | 242/129 |
| 4,089,486 | 5/1978 | Carter | 242/129 |
| 4,973,011 | 11/1990 | Wilson | 242/129 |

*Primary Examiner*—Stanley N. Gilreath

*Attorney, Agent, or Firm*—H. Gordon Shields

[57] ABSTRACT

Apparatus for dispensing coiled flexible electrical conduit includes a base having a fixed portion and a rotating portion and the rotating portion of the base is adapted to receive a container of the flexible electrical conduit. A form is placed within the container and within the coils of the flexible conduit within the container and is secured to the container and the rotating portion of the base to provide joint rotation of the rotating portion of the base, the container, and the form as flexible conduit is dispensed.

2 Claims, 1 Drawing Sheet

FIG. 1
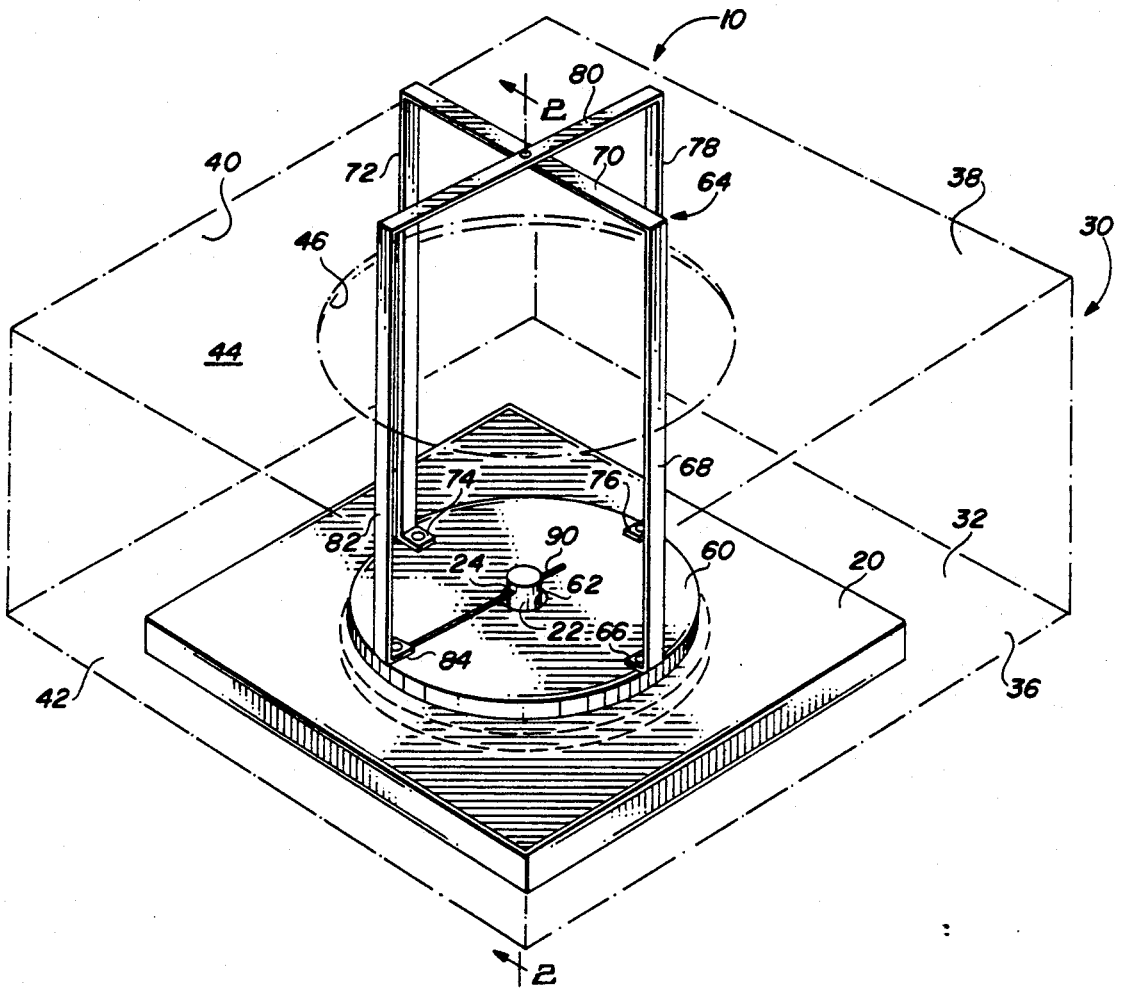
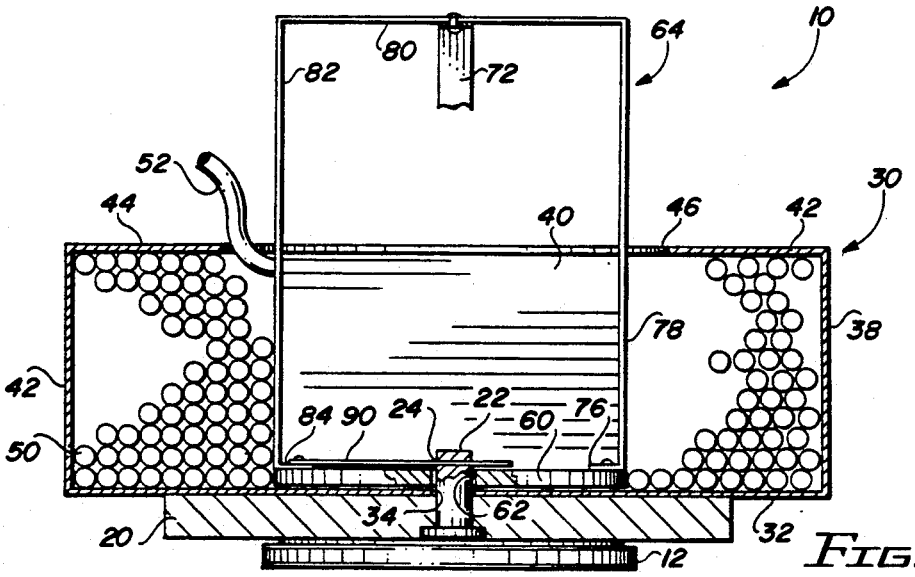
FIG. 2

DISPENSER FOR PLASTIC FLEX CONDUIT

BACKGROUND OF THE INVENTION

1. Field of the Invention

This invention relates to dispenser apparatus and, more particularly, to apparatus for dispensing coiled flexible conduit.

2. Description of the Prior Art

In recent years the electrical industry has developed flexible conduit through which electrical wires are run. The flexible conduit is made of plastic, and accordingly is nonconductive.

The flexible conduit generally comes in bulk quantities in which the conduit is coiled in a cardboard box. The cardboard box typically includes a removable portion in the top lid of the box from or through which the conduit may be dispensed. The box is used as both a shipping container and as a container from which the conduit is dispensed at the job site.

During shipping, the flexible conduit remains generally in its coiled configuration within the container, namely a coil configuration with an open area in the middle of the container and in the middle of the coil. The open area within the coils cooperates with the apparatus of the present invention, as is illustrated in the drawing and as will be discussed in detail below.

While the coil of flexible conduit remains generally intact during shipment, as soon as the opening is cut in the top of the box and the dispensing of the conduit begins, the conduit changes from the nicely coiled material to a rather chaotic, jumbled mess within the box or container and the removal or dispensing of the conduit then becomes a substantial hassle and the hassle increases as time goes by.

The apparatus of the present invention mates with the cardboard box container and maintains the conduit in its generally coiled configuration for simplifying the dispensing of the conduit and for preventing the chaotic mess that otherwise happens in the container.

U.S. Pat. No. 4,089,486 (Carter), the inventor of which is the inventor of the present apparatus, discloses a wire dispensing apparatus in which coils of wire are disposed and from which the wire is dispensed. A tub is movable on a fixed base, and a plate is disposed in the tub and is movable relative to the tub. Coiled wire is disposed on the plate and extends outwardly from the tub through an aperture in the side wall of the tub. A lid is placed on the coil to hold the wire in the tub. The plate includes a central cylindrical form about which the coiled wire is placed. The wire to be dispensed is removed from its shipping container and is placed in the tub and on the plate and the lid is then placed over the coil. The apparatus is obviously suitable for dispensing wire, but is not suitable for dispensing the coiled conduit.

SUMMARY OF THE INVENTION

The invention described and claimed herein comprises a fixed base, a rotatable base secured to the fixed base and movable or rotatable on the fixed base. The rotatable base includes a platform. The platform is adapted to receive a container which holds the coiled conduit.

A pan is disposed on the bottom of a container after the container is disposed on the platform. A pin extends upwardly from the platform also extends through the bottom of the container and through the pan and the pin includes an element for securing the pan to the container and to the platform.

A form extends upwardly from the pan and within the coils of the conduit. As conduit is dispensed from the container, the form maintains the generally coiled configuration of the conduit so that the conduit is prevented from becoming uncoiled or otherwise destroying the general integrity of the coils of the conduit.

Among the objects of the present invention are the following:

To provide new and useful conduit dispensing apparatus;

To provide new and useful apparatus for dispensing flexible conduit;

To provide new and useful apparatus for maintaining the integrity of coils of flexible conduit as the flexible conduit is dispensed;

To provide new and useful apparatus for dispensing flexible conduit and for maintaining the integrity of the coils of conduit as it is being dispensed; and To provide new and useful apparatus having a fixed base and a platform movable relative to the base and which platform receives a container of coiled flexible cable.

BRIEF DESCRIPTION OF THE DRAWING

FIG. 1 is a perspective view of the apparatus of the present invention.

FIG. 2 is a view in partial section taken generally along line 2—2 of FIG. 1.

DESCRIPTION OF THE PREFERRED EMBODIMENT

FIG. 1 is a perspective view of dispenser apparatus 10 for plastic flexible conduit embodying the present invention. FIG. 2 comprises a side view of the dispenser apparatus 10 taken generally along line 2—2 of FIG. 1. Included in FIG. 2 is a box or container 30 in which flexible conduit 50 is shown disposed in a coil within the box 30. In FIG. 1, the box 30 is simply outlined in dashed line, and the flexible conduit has been omitted. For the following discussion, reference will be made to both FIGS. 1 and 2.

The dispenser apparatus 10 includes a fixed base 12 on which a platform 20 is disposed for rotation. That is, the platform 20 comprises a rotatable portion appropriately secured to the base 12, such as by a "lazy susan" type assembly 14, well known and understood in the art, and which typically comprises simply a pair of relatively rotatable plates with bearing elements separating them. The platform 20 extends outwardly from the fixed base 12.

The fixed base 12 is preferably generally circular in configuration, while the platform 20 is preferably of a square configuration. The square configuration of the platform 20 is to receive the box or container 30 in which the flexible conduit 50 is appropriately coiled.

A pin 22 extends upwardly from the rotatable platform 20. The pin 22 cooperates with a form 64, as will be discussed in detail below.

The box or container 30 is generally made of cardboard or the like. The box 30 includes a bottom 32, four sides extending vertically upwardly from the bottom 32, including a side 36, a side 38, a side 40, and a side 42. As shown in FIG. 2, there is a central aperture or hole 34 extending through the bottom 32 of the box 30.

The box 30 is closed by a top 44. A relatively large generally circular aperture 46 extends through the top 44. The aperture 46 is a dispensing aperture through which the conduit 50 is dispensed from the box 30.

In the use of the dispenser apparatus 10, the box 30 is placed on the rotatable platform 20. The hole or aperture 34 is cut through the bottom 32 to accommodate the center post or pin 22. That is, the box 30 is centered on the platform 20 with the post 22 extending through the aperture or hole 34 in the bottom 32 of the box 30. While the aperture 46 in the top 44 may be scored, on the like, for base in removing the center portion of the top, there is nothing similar in the bottom 32 to help make the hole or aperture 34.

As indicated in FIG. 2, the flexible conduit 50 is coiled within the box 30 with the coils disposed generally against the four walls, thus leaving the center portion of the box open. In the center of the box 30, and disposed on the bottom 32 of the box, is placed a pan 60. The pan 60 includes a center hole or aperture 62 which is disposed over the pin or post 22. The hole or aperture 62 is thus aligned with the hole 34 in the bottom 32 of the box 30. The post 22 extends upwardly above the pan 60.

The form 64 extends upwardly from, and is appropriately secured to, the pan 60. The form 64 simply comprises four vertically extending members secured together to form 64 extends upwardly above the top 42 of the box 30 to provide appropriate guidance for the conduit 50 as it is pulled out of the box 30 through the top 44. Moreover, the top or upper portion of the form 64 may be used as a handle for moving the apparatus 10 and the box 30.

The form 64 includes a foot 66 which is disposed on and secured to the pan 60. A vertically extending member 68 is secured to the foot 66. At the top of the vertical member 68 there is a top cross member 70. Extending downwardly from the top cross member 70, remote from the vertical member 68, is another vertical member 72. At the bottom of the vertical member 72 is an inwardly extending foot 74. The foot 74 is also appropriately secured to the pan 60. The vertical members 68 and 72 are generally parallel to each other, as are the feet 66 and 74. The feet 66 and 74 are also aligned with each other. For convenience, the top cross member 70 is generally perpendicular to the vertical members 68 and 72.

At a generally perpendicular orientation to the members 68, 70, and 72, and their respective feet 66 and 74, is a second portion of the form 64. The second portion includes an inwardly extending foot 76, a vertical member 78, a top cross member 80, another vertical member 82, and another inwardly extending foot 84. The vertical members 78 and 82 are generally parallel to each other, as are the inwardly extending feet 76 and 84. The feet 76 and 84 are appropriately secured to the pan 60. The top cross member 80 is generally perpendicular to the vertical members 78 and 82.

The cross members 70 and 80 are appropriately secured to each other to provide the necessary rigidity for the form 64 as it is disposed on the pan 60 and as the conduit 50 unwinds about it. The cross members 70 and 80 may also comprise handle elements for carrying or moving the box 30 and the dispenser apparatus 10 from one location to another.

As indicated in both FIGS. 1 and 2, the form 64 extends upwardly above the top 44 of the box 30 for a substantial distance. The pan 60, as appropriately secured to the form 64, is locked to the base 12 and to the rotatable platform 20 by means of a lock element 90. The lock element 90 may appropriately be a length of cable or any other type of pin which is flexible enough to extend through a horizontally extending aperture 24 in the center post 22. The hole or aperture 24 extends diametrically through the pin 22, and the lock element 90 extends preferably completely through the aperture 24 so as to lock the form 64 to the pan 60.

As indicated, the lock element 90 may be a piece of relatively stiff, but yet flexible, cable wire, or the like. It also may be a separate pin element secured to a short length of chain, or the like. The idea is to provide a relatively simple lock arrangement between the pan 60 and the platform 64 that will remain in place during the rotation of the platform 20 and the box 30 secured thereto as the conduit 50 is dispensed through the aperture 46 and about the form 64. Yet, the lock element 90 should be relatively easily removed to allow the pan 60 and the form 64 to be removed from the box 30 when the conduit 50 has all been dispensed from a box 30 in order to put a full box 30 of the conduit 50 on the platform 20.

Obviously, other particular designs of the form 64 may also be used, since the form 64 is simply to provide a structure about which the conduit 50 may be unwound as the conduit is moved out of its box 30. The presence of the form 64 prevents the conduit 50 from becoming tangled in the box as it is being dispensed. Thus, the form 64 essentially holds the coils of the conduit 50 generally in place in the box 30 while the conduit is being dispensed.

In FIG. 2, an end 52 of the conduit 50 is shown extending outwardly from the box 30 through the top aperture 46 and about the form 64.

Since the form 64 is secured to the pan 60, and the pan 60 is in turn secured to the platform 20, with the box 30 intermediate or between the platform 20 and the pan 60, the box 30 is also appropriately secured to the platform 20 and through the platform 20 to the base 12. With the base 12 fixed, and the platform 20 rotatable thereon, the platform 20, the box 30, and the pan 60 and the form 64 all rotate as the conduit 50 is dispensed from the box 30.

For convenience of movement, the form 64 may simply be grasped and held. And since all of the several elements are tied or secured together, the entire apparatus 10 may be appropriately moved from location to location as desired. The base 12, the platform 20, and the pan 60 and its form 64 are sturdy enough to enable them to hold together with the box 30 secured to them for joint movement.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Dispenser apparatus for dispensing flexible electrical conduit coiled in a box, comprising in combination:

a fixed base;

a rotatable base secured to the fixed base and rotatable relative to the fixed base;

a platform secured to the rotatable base for receiving the box containing the coiled flexible conduit, the box having a bottom in the box and disposed on the platform;

a pan disposed in the box on the bottom of the box when the box is disposed on the platform;

means for securing the box and the pan to the platform, including a pin secured to the platform and extending upwardly through the bottom of the box and through the pan, an aperture through the pin adjacent to the pan, and a locking element secured to the pan and extending through the aperture; and form means secured to the pan and extending upwardly therefrom and within the coiled flexible conduit for maintaining the conduit in its coiled form as the conduit is dispensed.

2. The apparatus of claim 1 in which the form means includes a plurality of vertical members secured to the pan and extending upwardly from the box.

* * * * *